US010859086B2

(12) United States Patent
Trentin et al.

(10) Patent No.: US 10,859,086 B2
(45) Date of Patent: Dec. 8, 2020

(54) CENTRIFUGAL ELECTRIC PUMP AND VOLUTE FOR SUCH AN ELECTRIC PUMP

(71) Applicant: DAB PUMPS S.P.A., Mestrino (IT)

(72) Inventors: Enrico Trentin, Gambellara (IT); Francesco Sinico, Montecchio Maggiore (IT); Giuseppe Di Giovanni, Selvazzano Dentro (IT)

(73) Assignee: DAB PUMPS, S.P.A., Mestrino (IT)

( * ) Notice: Subject to any disclaimer, the term of this patent is extended or adjusted under 35 U.S.C. 154(b) by 71 days.

(21) Appl. No.: 15/268,272

(22) Filed: Sep. 16, 2016

(65) Prior Publication Data

US 2017/0089344 A1 Mar. 30, 2017

(30) Foreign Application Priority Data

Sep. 28, 2015 (IT) ..... 102015000055623

(51) Int. Cl.

| | |
|---|---|
| ***F04D 13/06*** | (2006.01) |
| ***F04D 29/02*** | (2006.01) |
| ***F04D 1/00*** | (2006.01) |
| ***F04D 29/42*** | (2006.01) |
| ***F04D 29/62*** | (2006.01) |
| ***F04D 1/02*** | (2006.01) |
| ***F04D 29/08*** | (2006.01) |
| *F04D 29/70* | (2006.01) |

(52) U.S. Cl.

CPC ..... *F04D 13/06* (2013.01); *F04D 1/00* (2013.01); *F04D 1/02* (2013.01); *F04D 29/02* (2013.01); *F04D 29/086* (2013.01); *F04D 29/426* (2013.01); *F04D 29/4293* (2013.01); *F04D 29/628* (2013.01); *F04D 29/708* (2013.01); *F05D 2300/43* (2013.01)

(58) Field of Classification Search

CPC ... F04D 1/00; F04D 1/02; F04D 13/06; F04D 29/02; F04D 29/086; F04D 29/426; F04D 29/4293; F04D 29/628

See application file for complete search history.

(56) References Cited

U.S. PATENT DOCUMENTS 3,656,861 A 4/1972 Zagar
3,958,894 A 5/1976 Rowley et al.
(Continued)

FOREIGN PATENT DOCUMENTS

CN 202900782 4/2013
EP 1178216 A2 2/2002
(Continued)

OTHER PUBLICATIONS

Italian Search Report IT UB20153948, completed Jun. 2, 2016.
(Continued)

*Primary Examiner* — Patrick Hamo
(74) *Attorney, Agent, or Firm* — Ferguson Case Orr Paterson LLP

(57) ABSTRACT

Centrifugal electric pump, comprising a pump body, with an aspiration inlet and a delivery outlet, a hydraulic volute, within which an impeller is accommodated, and comprising an electric motor for moving the impeller.
The hydraulic volute is constituted by two half-shells made of plastic material and mutually joined with joining means and with sealing means.

6 Claims, 5 Drawing Sheets

(56) References Cited

U.S. PATENT DOCUMENTS 4,822,241 A * 4/1989 Jarvis ..... A47L 15/4225 415/104
5,127,800 A 7/1992 Hyll
5,172,562 A * 12/1992 Manz ..... F25B 45/00 62/149
6,135,728 A * 10/2000 Klein ..... F04D 29/0413 417/420
6,322,330 B1 * 11/2001 Thomas ..... F04B 43/1253 417/360
7,373,946 B2 * 5/2008 Sigler ..... B60R 15/04 137/205
8,376,432 B1 * 2/2013 Hagler ..... B66C 1/62 294/67.22
8,616,862 B2 * 12/2013 Meza ..... F04B 43/02 417/413.1
8,844,771 B2 * 9/2014 Centofante ..... F04B 43/12 222/167
2012/0321440 A1 * 12/2012 Zheng ..... F04D 29/685 415/58.4
2013/0115071 A1 5/2013 Miller et al.
2013/0136587 A1 * 5/2013 Wang ..... F04D 25/0606 415/191
2014/0271123 A1 9/2014 Rosinski
2014/0294626 A1 * 10/2014 Aso ..... F04D 13/0606 417/410.1
2015/0003966 A1 * 1/2015 Duquette ..... F04D 29/30 415/119
2016/0123328 A1 * 5/2016 Drechsel ..... F04D 13/025 417/423.14
2017/0159673 A1 * 6/2017 Stewart ..... F04D 29/4293
2018/0283388 A1 * 10/2018 Fukuyama ..... F04D 25/028
2019/0078571 A1 * 3/2019 Dieckhaus ..... F04D 13/0633

FOREIGN PATENT DOCUMENTS

EP 2088326 A2 8/2009
EP 2781758 A1 11/2011
EP 2455616 A2 5/2012
WO 2005033517 4/2005
WO 2011062633 5/2011

OTHER PUBLICATIONS

Spanish Office Action, Application No. 201631195, dated Sep. 15, 2016, reported Jan. 27, 2017.
Chinese Office Action for Application No. 2016108510181, dated Apr. 28, 2019.

* cited by examiner

CENTRIFUGAL ELECTRIC PUMP AND VOLUTE FOR SUCH AN ELECTRIC PUMP

The present invention relates to a centrifugal electric pump.

The invention also relates to a hydraulic volute for such a centrifugal electric pump.

Nowadays it is accepted that the hydraulic performance of a dynamic operating machine is due to the impeller, which transfers the mechanical energy of the motor to the liquid pumped in the form of kinetic energy and pressure energy.

The liquid pumped out by the impeller is conveyed to a diffuser or to a volute, whose task is to convert part of the kinetic energy to pressure energy.

While usually a diffuser can be made either of plastic material or of pressed metal plate in order to be easily inserted into a pump body that conveys the liquid to the delivery outlet, a volute on the other hand, owing to its particular translation screw shape, is made in a single piece by way of a casting of iron or other material, in a production process that involves the use of cores of earth or sand which have to be removed and eliminated for every piece made.

Therefore often the volute and the pump body are a single component made of cast iron, which is heavy and expensive to provide.

In pumps where it is not required or it is not possible to adopt a pump body made of cast iron, such as for example electric pumps for swimming pools, a diffuser is employed which is made of plastic material, the functionality of which in terms of conversion of kinetic energy to pressure energy may not be optimal.

Furthermore, a volute made of cast iron, owing to the intrinsic peculiarities of the material, has a rough surface, even if only moderately so, and this characteristic does not favor the optimal flowing of the liquid pumped, contributing to produce an unwanted drop in pressure.

The aim of the present invention is to provide a centrifugal electric pump that is capable of overcoming the above mentioned limitations of conventional similar pumps.

Within this aim, an object of the invention is to provide a centrifugal electric pump that is capable of optimizing the conversion of the kinetic energy transmitted by the impeller to the fluid to pressure energy.

Another object of the invention is to provide a centrifugal electric pump that is simple to provide and assemble.

Another object of the invention is to provide a volute for hydraulic pumps that fits to an electric pump according to the invention, and which is simple and low cost to provide.

This aim and these and other objects which will become better evident hereinafter are achieved by a centrifugal electric pump, comprising a pump body, with an aspiration inlet and a delivery outlet, a hydraulic volute within which an impeller is accommodated, and comprising an electric motor for moving said impeller, said centrifugal electric pump being characterized in that said volute is constituted by two half-shells made of plastic material, mutually joined with joining means and with sealing means.

Further characteristics and advantages of the invention will become better apparent from the detailed description that follows of a preferred, but not exclusive, embodiment of the centrifugal electric pump according to the invention, which is illustrated for the purposes of non-limiting example in the accompanying drawings wherein.

Figure 1:
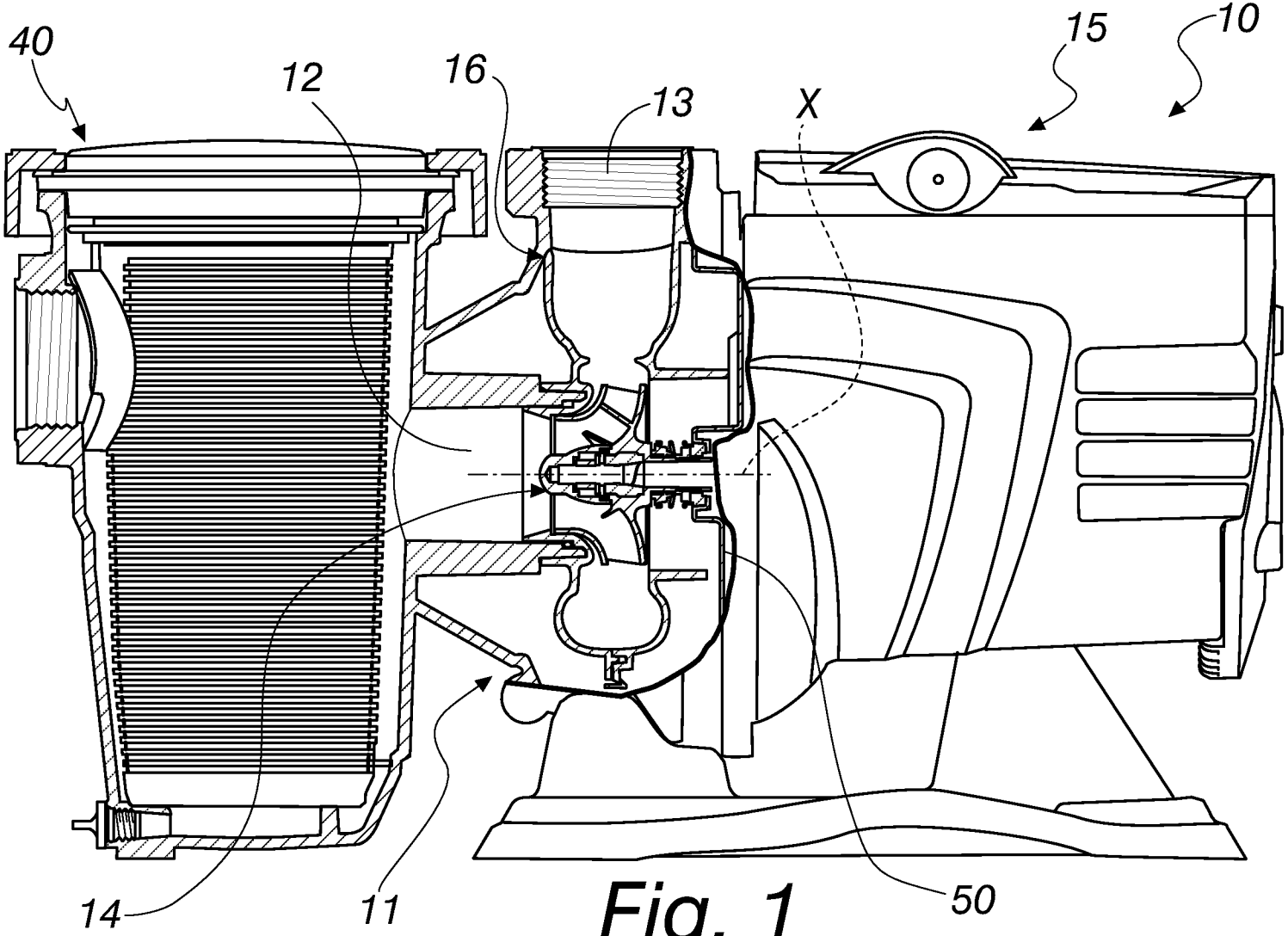
FIG. 1 is a partially cutaway side view of a centrifugal electric pump according to the invention.
Figure 2:
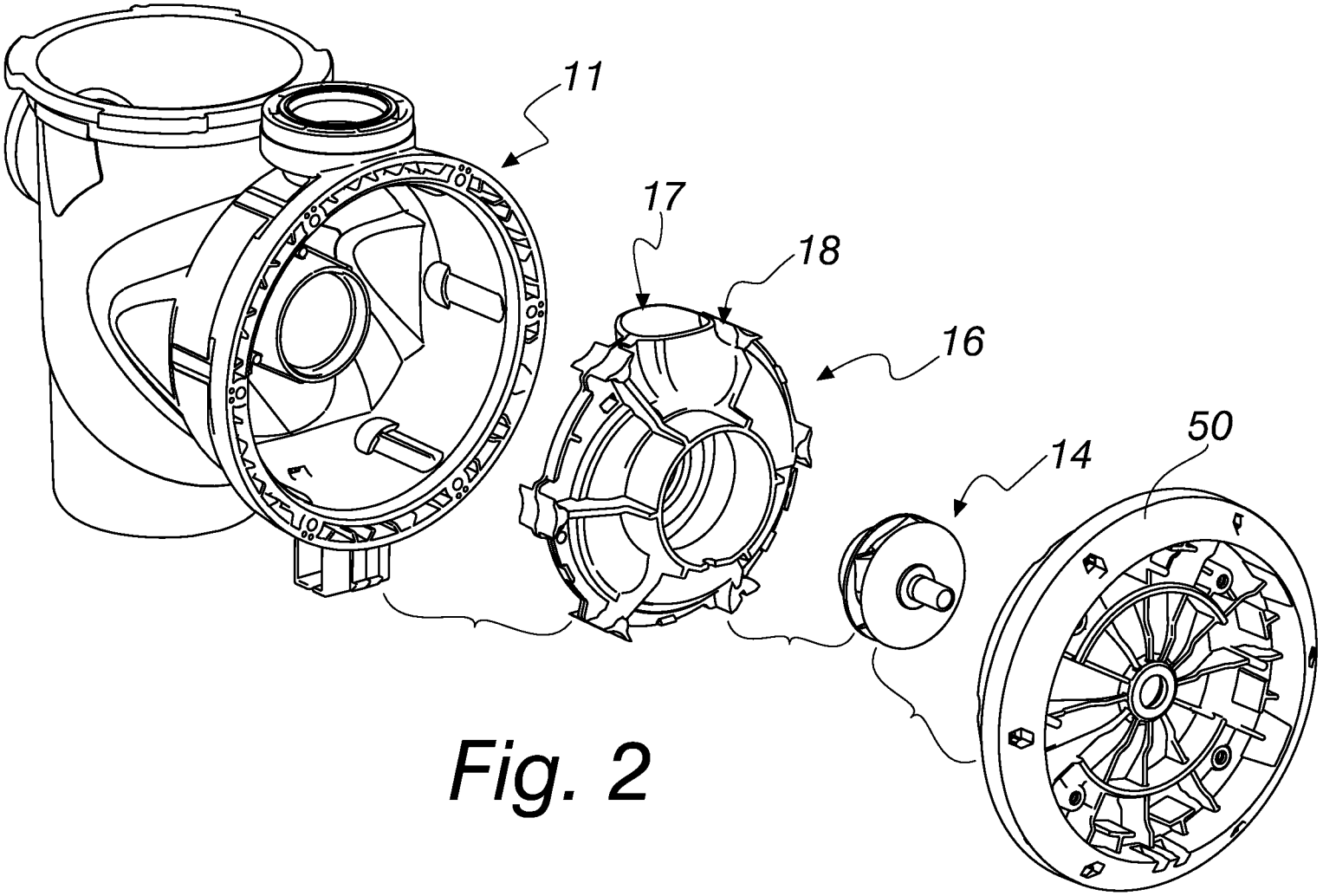
FIG. 2 is an exploded perspective view of a centrifugal electric pump according to the invention.
Figure 3:
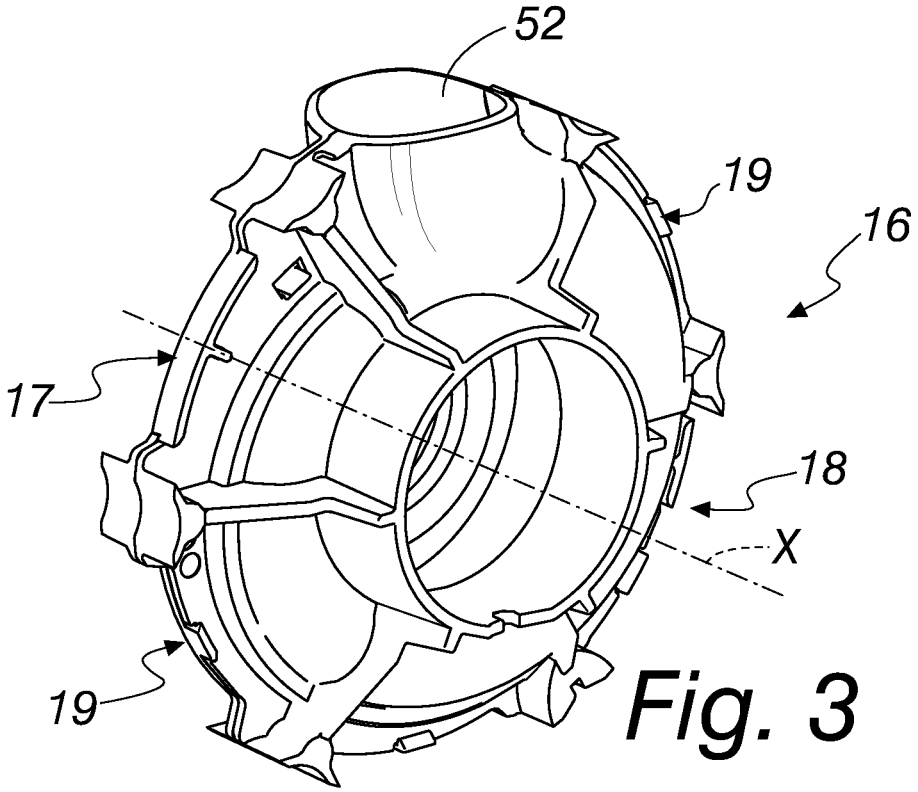
FIG. 3 is a view of a volute according to the invention.
Figure 4:
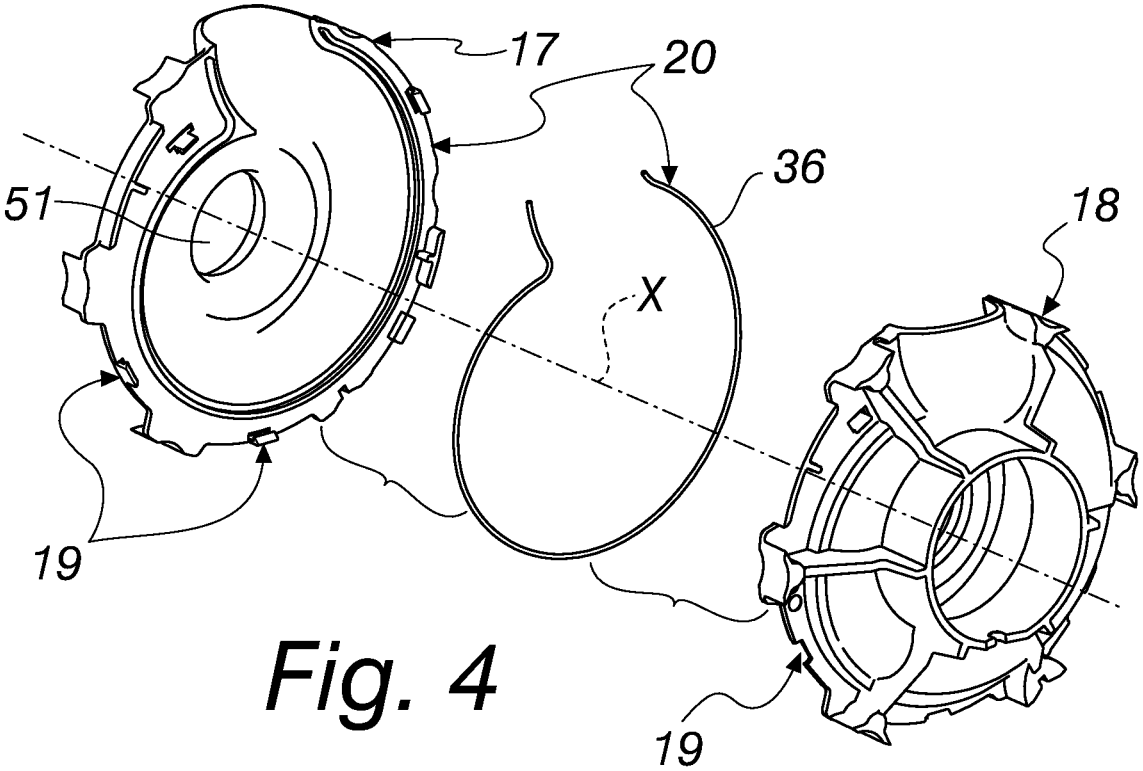
FIG. 4 is an exploded perspective view of a volute according to the invention.

With reference to the figures, a centrifugal electric pump according to the invention is generally designated with the reference numeral 10.

The centrifugal electric pump 10 comprises a pump body 11, with an aspiration inlet 12 and a delivery outlet 13, and a hydraulic volute 16 within which an impeller 14 is accommodated.

The electric pump 10 also comprises an electric motor 15 for moving the impeller 14.

The peculiarity of the centrifugal electric pump 10 according to the invention consists in that the volute 16 is constituted by two half-shells 17 and 18 made of plastic material, which are mutually joined with joining means 19 and with sealing means 20.

The pump body 11 also comprises a flanging disk 50 for the coupling of the electric motor 15.

The half-shells 17 and 18 are joined at a plane that lies transversely to the rotation axis X of the impeller 14, the latter being accommodated within the volute 16.

The two half-shells 17 and 18, joined together, define a spiral volute 16 with an axial inlet 51, connected to the aspiration inlet 12 of the pump body 11, and a radial outlet 52, connected to the delivery outlet 13 of the pump body 11.

Figure 6:
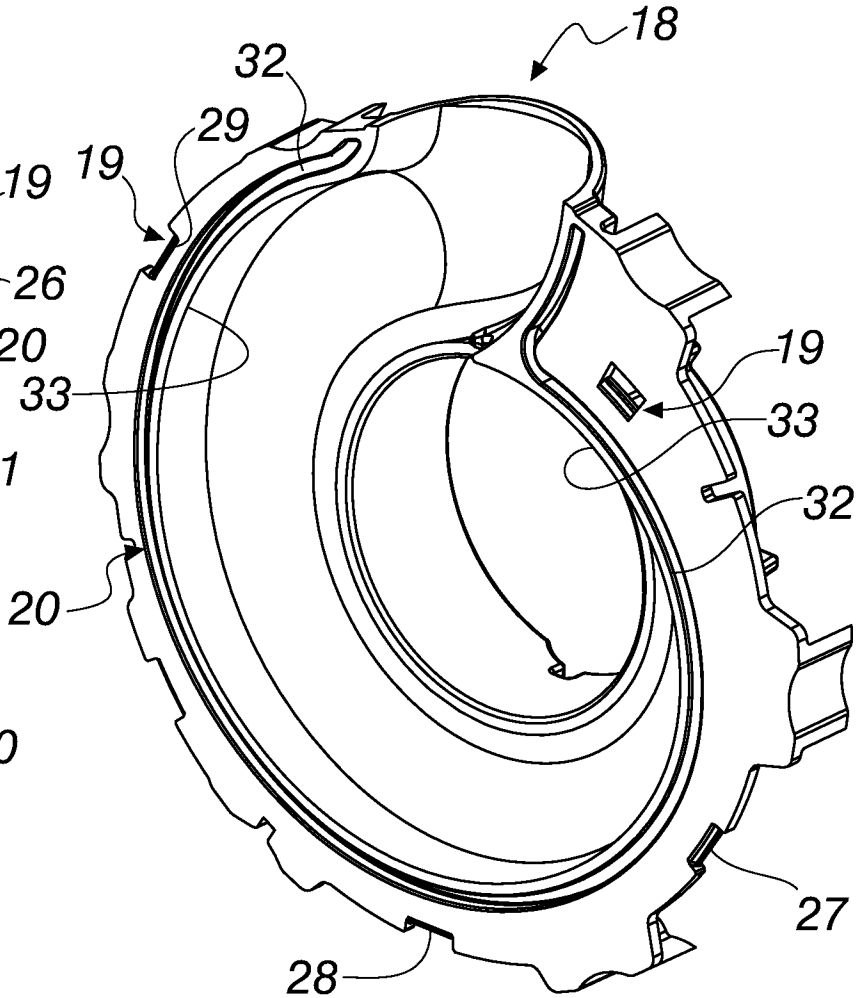
FIG. 6 is a perspective view of another half-shell of a volute according to the invention.
Figure 5:
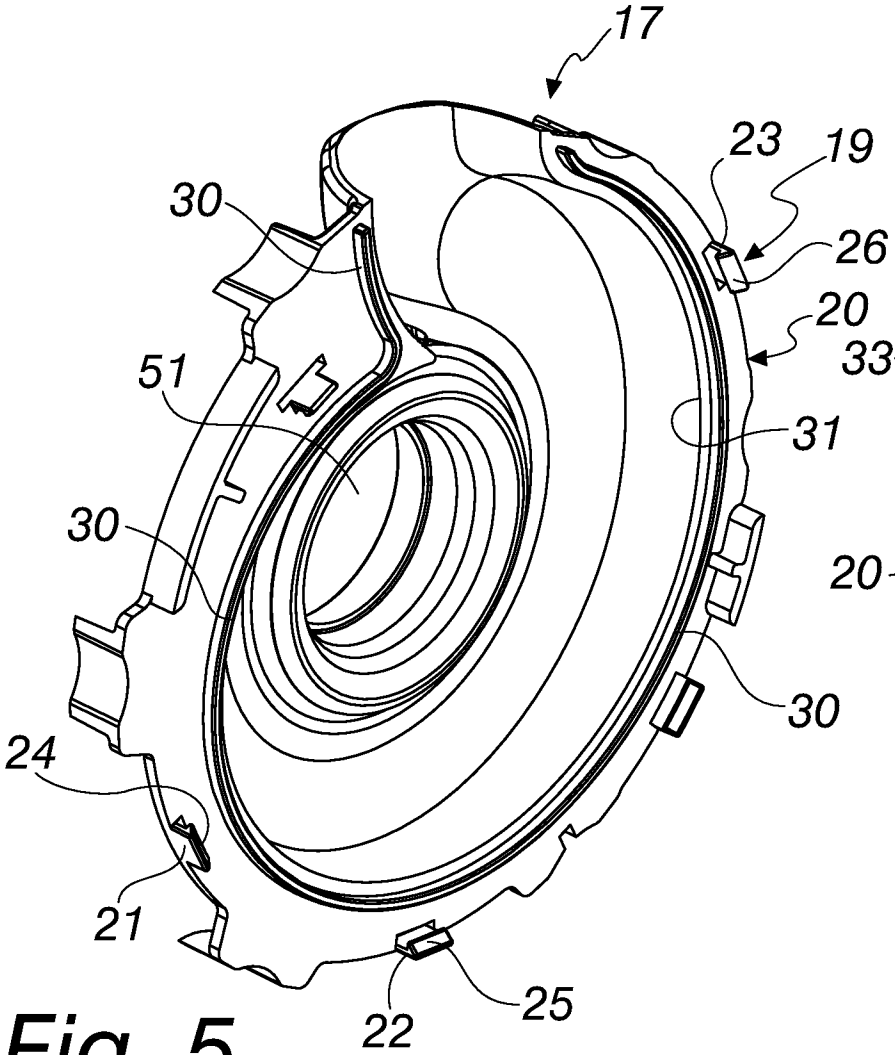
FIG. 5 is a perspective view of a half-shell of a volute according to the invention.

In the present embodiment of the invention, which is to be understood as a non-limiting example of the invention, the joining means 19 comprise a plurality of elastically deformable raised portions, for example 21, 22, 23 in FIGS. 5 and 6, with a respective engagement tooth 24, 25, 26, which protrude from a first half-shell 17 and are adapted for snap coupling with corresponding recesses 27, 28, 29 which are defined on the second half-shell 18.

Figure 8:
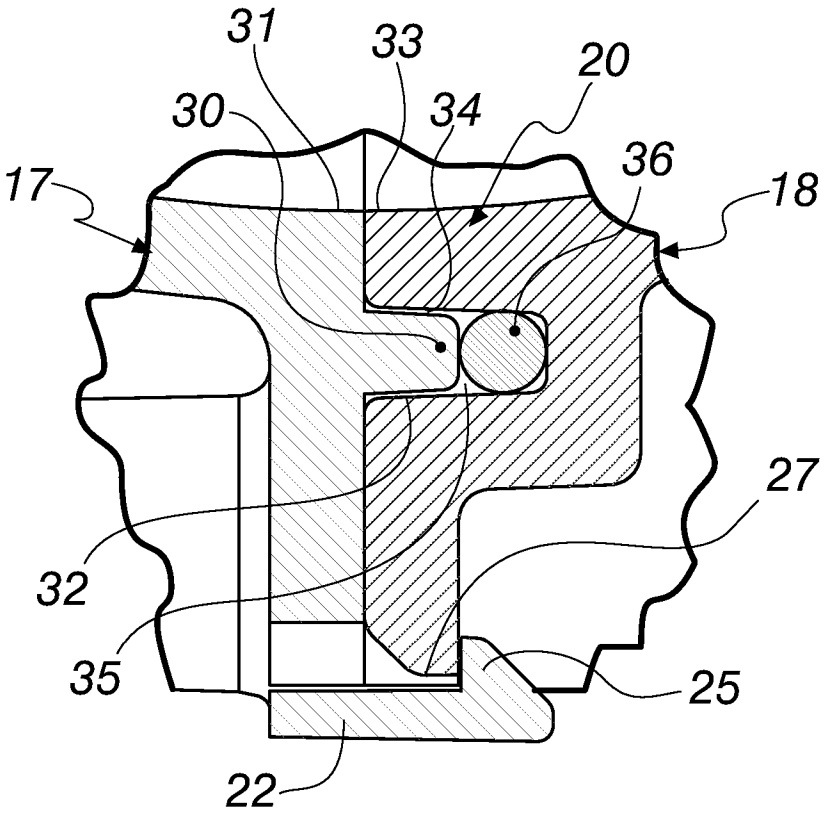
FIG. 8 is a detail of FIG. 7.
Figure 7:
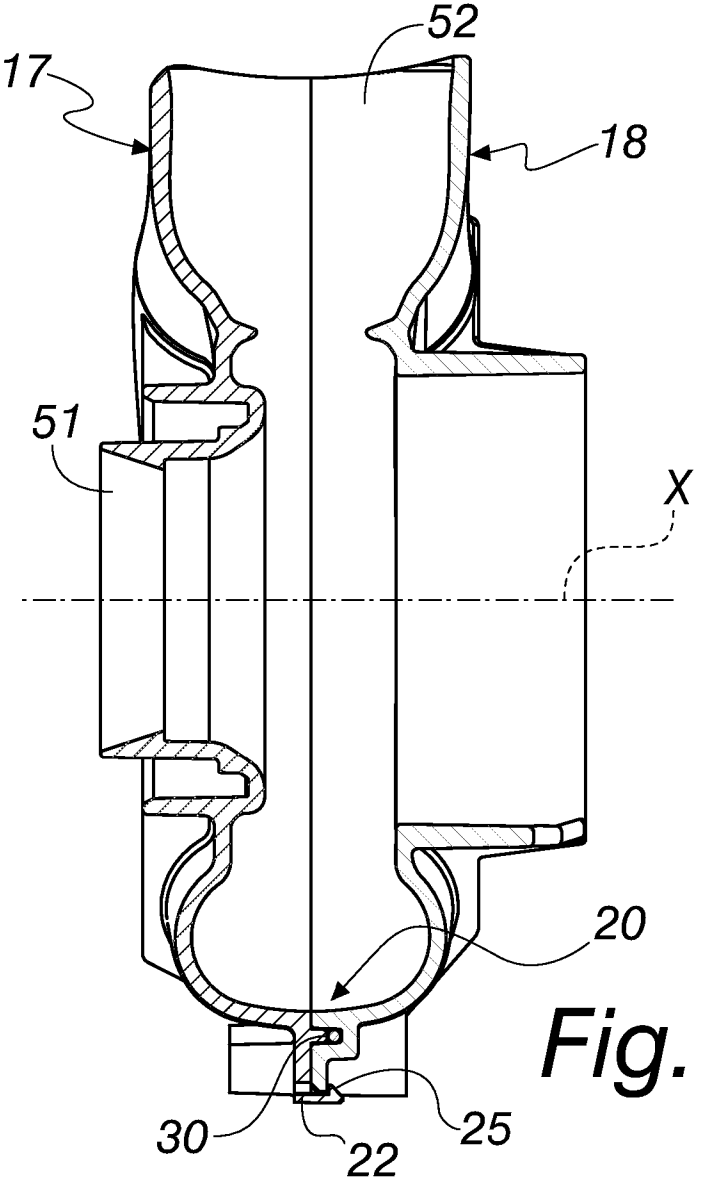
FIG. 7 is a transverse cross-sectional view of a volute according to the invention.

In the present embodiment of the invention, which is to be understood as a non-limiting example of the invention, the sealing means 20 comprise a rib 30, clearly visible in FIGS. 5, 7 and 8, which is extended so as to surround the inner edge 31 of the first half-shell 17, and a complementarily shaped groove 32, clearly visible in FIGS. 6, 7 and 8, which is extended so as to surround the facing inner edge 33 of a second half-shell 18.

The rib 30 is inserted in the groove 32 so as to define between them a labyrinthine sealing interspace 34, clearly visible in FIG. 8.

The labyrinthine sealing interspace 34 is sufficient to assure the hydraulic seal of the join between the two half-shells 17 and 18.

If the specific context requires it, a seat 35 for a gasket 36 adapted to increase the seal is defined between the rib 30 and the bottom of the groove 31.

Each one of the half-shells 17 and 18 are conveniently and economically made of plastic material, with normal simple molds, without special and expensive undercuts.

Such a volute 16 is therefore economical to provide in plastic material, and such plastic material makes it possible to provide a volute 16 with inner walls that are smooth and adapted to optimize the flow of the pumped fluid, differently from what occurs in volutes made of cast iron.

Such a hydraulic volute 16 is produced without resorting to the costly molding processes for cast iron.

The volute 16 can be assembled in an intuitive manner even by staff without any special prior training, it being necessary and sufficient to axially juxtapose the two half-shells and push them onto each other until the connecting teeth click into the respective recesses, after the optional interposition, if necessary, of the gasket 36.

The pump body 11 also comprises a prefiltration unit 40, of conventional type, connected to the aspiration inlet 12, which makes the centrifugal electric pump 10 well adapted to the circulation and filtration of water in domestic and residential swimming pools, as well as for particular applications that require the movement of aggressive liquids, in fish farming, agriculture and industry.

It should be understood that the invention also relates to a hydraulic volute 16 as described above, for a centrifugal electric pump as also described above, such hydraulic volute 16 being characterized in that it is constituted by two half-shells 17, 18 which are mutually joined with joining means 19 and with sealing means 20 as described above.

In practice it has been found that the invention fully achieves the intended aim and objects.

In particular, with the invention a centrifugal electric pump has been devised that is capable of optimizing the conversion of the kinetic energy transmitted by the impeller to the fluid to pressure energy, thanks to the presence within it of the volute constituted by two half-shells made of plastic material, which, in addition to offering improved performance with respect to a diffuser, since it is made of plastic material it has a smoother internal surface than an identical volute made of cast iron, and therefore it is better performing for the flow of the pumped fluid.

What is more, with the invention a centrifugal electric pump has been devised that is simple to provide and assemble, thanks to the volute comprised of two half-shells made of plastic material which can be provided by molding plastic material using molds that are relatively simple because they are free from complex undercuts.

Moreover, with the invention a volute for hydraulic pumps has been devised which fits to an electric pump according to the invention, and is simple and economic to provide.

The invention, thus conceived, is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The invention claimed is:

1. A centrifugal electric pump, comprising a pump body, with an aspiration inlet and a delivery outlet, a hydraulic volute within which an impeller is accommodated, and comprising an electric motor for moving said impeller, wherein the hydraulic volute is accommodated in the pump body, said centrifugal electric pump being characterized in that said volute is constituted by two half-shells made of plastic material, mutually joined with joining means and with sealing means, wherein said joining means comprises a plurality of elastically deformable raised portions with a respective engagement tooth, which are formed on a first half-shell and are adapted for snap coupling with corresponding recesses which are formed on the second half-shell shell.

2. The centrifugal electric pump according to claim 1, characterized in that said half-shells are joined at a plane that lies transversely to the rotation axis (X) of the impeller accommodated inside said volute.

3. The centrifugal electric pump according to claim 1, characterized in that said sealing means comprise a rib which is extended so as to surround an inner edge of & the first half-shell and a complementarily shaped groove which is extended so as to surround a facing inner edge of the second half-shell, said rib being inserted in said groove so as to define between them a labyrinthine sealing interspace.

4. The centrifugal electric pump according to claim 3, characterized in that between said rib and a bottom of said groove there is a seat for a gasket.

5. The centrifugal electric pump according to claim 1, characterized in that said pump body comprises a prefiltration unit connected to the aspiration inlet.

6. A hydraulic volute for a centrifugal electric pump that is configured to be accommodated in a pump body of a centrifugal electric pump and is capable of having an impeller accommodated within and characterized in that it is constituted by two half-shells made of plastic material, which are mutually joined with joining means and with sealing means, wherein said joining means comprises a plurality of elastically deformable raised portions with a respective engagement tooth, which protrude from a first half-shell and are adapted for snap coupling with corresponding recesses which are defined on the second half-shell shell.

* * * * *